US005713139A

United States Patent [19]

Briggs

[11] Patent Number: 5,713,139

[45] Date of Patent: Feb. 3, 1998

[54] QUIET OPERATING INDUSTRIAL DRYER

[75] Inventor: David L. Briggs, Naperville, Ill.

[73] Assignee: Ellis Corporation, Itasca, Ill.

[21] Appl. No.: 640,189

[22] Filed: Apr. 30, 1996

[51] Int. Cl.[6] ..... F26B 11/02

[52] U.S. Cl. ..... 34/607; 34/603; 432/105

[58] Field of Search ..... 34/202, 212, 216, 34/225, 235, 242, 595, 554, 599, 602, 603, 604, 607, 609; 432/105

[56] References Cited

U.S. PATENT DOCUMENTS

| | | | |
|---|---|---|---|
| 3,883,959 | 5/1975 | Neville | 34/599 |
| 4,626,201 | 12/1986 | Grantham | 432/105 |
| 5,185,941 | 2/1993 | Dongelmans | 34/242 |

*Primary Examiner*—Henry A. Bennett
*Assistant Examiner*—Steve Gravini
*Attorney, Agent, or Firm*—Leydig, Voit & Mayer, Ltd.

[57] ABSTRACT

An improved industrial dryer adapted for more efficient, quieter and safer operation. The dryer blower has a relatively large size blower wheel adapted for generating high volume air flows at substantially reduced noise levels so as not to disrupt the work environment nor necessitate that workers wear ear protection. The blower is mounted on a pivotal door of the housing for easy access and an adjacent air feed cone is mounted for selective adjustable positioning into axial relation with the blower wheel for efficient air distribution. The dryer includes a burner adapted for generating a multi-leg, relatively short length discharge flame for enhancing fuel combustion and maximizing surface area over which air passes and is heated as it is drawn to the tumbler of the dryer.

22 Claims, 5 Drawing Sheets

QUIET OPERATING INDUSTRIAL DRYER

FIELD OF THE INVENTION

The present invention relates generally to dryer systems, and more particularly to dryers used in industrial laundries.

BACKGROUND OF THE INVENTION

Dryers for industrial laundry usage requires blowers capable of directing high volume heated air flows, such as on the order of 6,500 to 11,000 cubic feet per minute (cfm), in order to achieve efficient drying of large laundered loads weighing up to 600 pounds. Heretofore, the blowers of such industrial dryers have been susceptible to various operating drawbacks and problems.

To achieve the necessary drying efficiency, the blowers of conventional dryers must be operated at relatively high RPM, which can create unacceptably high noise levels. In an effort to reduce noise levels, the blowers have utilized reverse inclined blower wheel blades. Blowers of such type typically are operated in the range of 1,800 to 3,600 RPM, which can still create noise levels of between 80 and 95 decibels and require workers to wear ear protection, either in the form of uncomfortable ear plugs or expensive electronic protection.

Such blowers with reverse inclined blades also are susceptible to trapping and accumulating lint, threads, and other materials which become airborne during the drying operation. Moreover, some laundries use detergents or laundry water additives which may leave a sticky residue on blower wheel blades which tend to increase lint accumulation.

Lint collected on the blower wheel can cause the wheel to become unbalanced with resultant vibration during high speed operation and reduced bearing life. Moreover, lint accumulation can create a dangerous fire hazard. Gas burners for such industrial dryers typically eject flames up to five or more feet. The flame often is directed toward the dryer drum, which increases the risk of igniting accumulated lint. Efforts to direct the flame around the dryer housing in order to minimize the risk of lint ignition have required costly duct work.

Heretofore, cleaning lint from the blower often has required awkward access through a relatively small clean out door. Due to the size and location of such cleanout doors, cleaning may not be properly effected, thereby aggravating the accumulated lint and fire hazard problems. In an effort to obtain better access to the blower wheel for lint cleaning, it has been proposed to mount the blower on a pivotal door that enables the blower to be swung to an open position for permitting access to the blower wheel. Such door mounted blowers, however, are difficult to properly align with the air direction cone within the blower housing, through which air is channeled to the blower wheel. Because the blower assemblies are quite heavy, weighing up to 300 pounds, proper positioning of the blower on the door may require several workers or mechanical equipment. The problems of effecting proper alignment is compounded by the fact that adjustment usually is required in vertical, horizontal, and diagonal directions. If the door mounting hinges do not maintain the door in its proper alignment with the air feed cone, air flow and heating efficiency can be significantly impeded. Likewise, wear to the feed cone from abrasive airborne materials can impede air flow and drying performance and may necessitate costly repair and replacement of the cone.

OBJECTS AND SUMMARY OF THE INVENTION

It is an object of the present invention to provide an industrial dryer that is susceptible to more economical manufacture and more efficient, quieter, and safer operation.

Another object is to provide a dryer as characterized above which has a blower adapted for generating higher volume air flows at substantially reduced noise levels so as not to disrupt the work environment nor necessitate that workers wear ear protection.

A further object is to provide a dryer of the above kind which has a blower that is operable with lower horsepower motors.

Still another object is to provide a dryer having a pivotal door mounted blower for easy access and lint removal, but which can be more easily assembled and maintained in concentric aligned relation with respect to an air feed cone disposed within the dryer housing.

Yet another object is to provide a dryer of such type in which the air feed cone is adjustable relative to the blower and is adapted for easy replacement following prolonged usage and wear.

Another object is to provide a dryer having a burner which minimizes the risk of ignition of accumulated lint on the blower wheel and throughout the entire system.

Other objects and advantages of the invention will become apparent upon reading the following detailed description and upon reference to the drawings, in which:

DESCRIPTION OF THE PREFERRED EMBODIMENT

Figure 1:
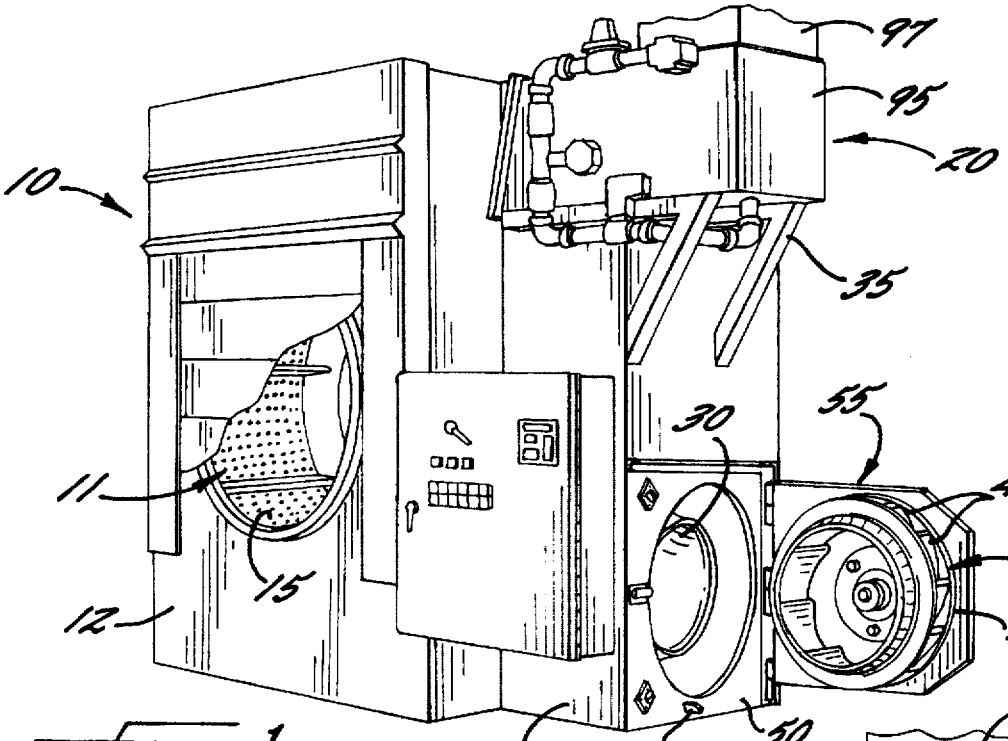
FIG. 1 is an perspective of an illustrative industrial dryer embodying the present invention.
Figure 2:
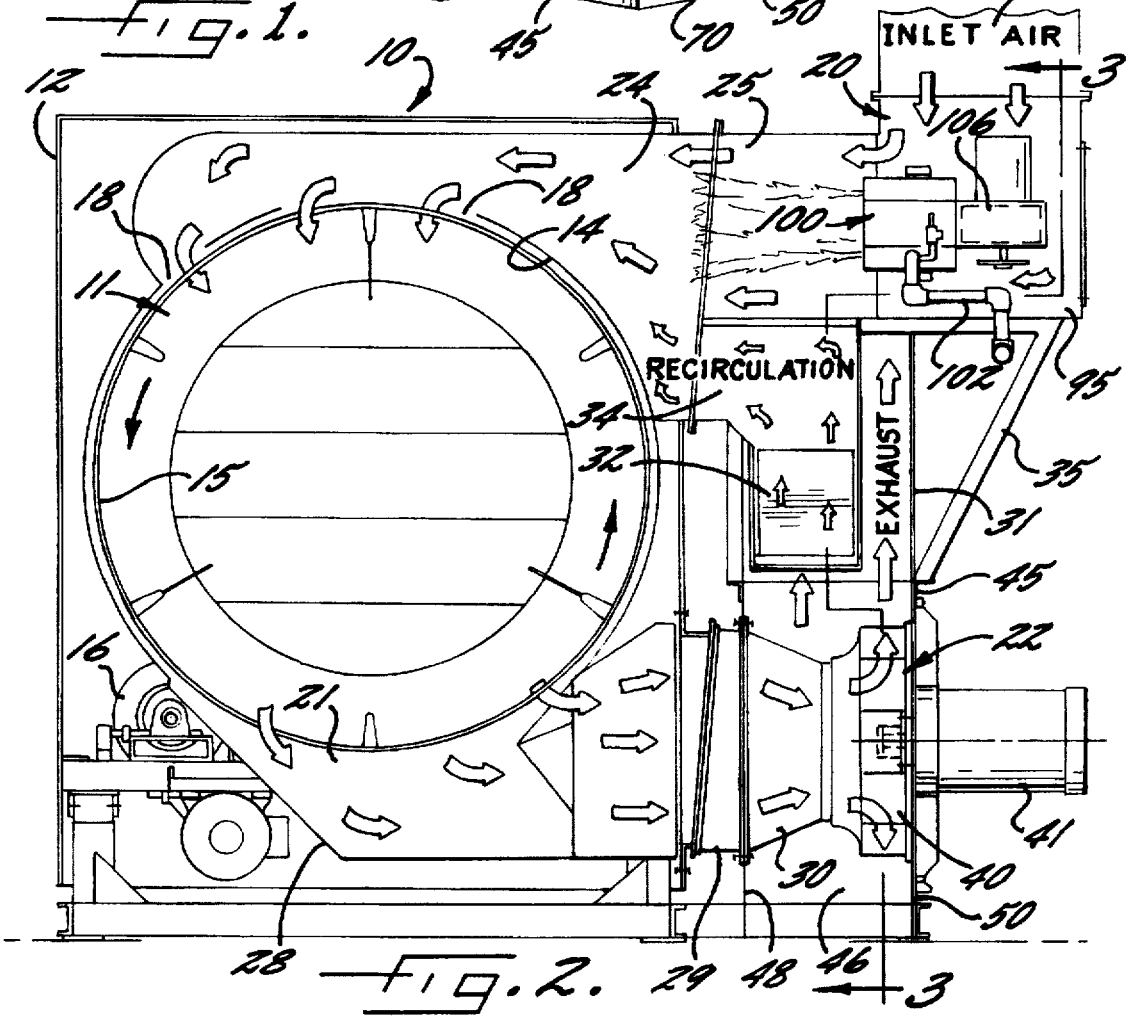
FIG. 2 is an enlarged vertical section of the dryer shown in FIG. 1.

Referring now more particularly to the drawings, there is shown an illustrative dryer 10 embodying the present invention typically used in industrial or commercial laundries for drying large quantities of laundered garments or other items. The dryer 10 includes a tumbler 11 which comprises a housing 12 having an inner shell 14 with a rotary basket 15 within which items to be dried are contained. The basket 15 is rotatably driven by a drive motor 16 in a conventional manner. The inner shell 14 has air inlet openings 18 on a top side thereof which communicate with a gas burner 20, and an air outlet opening 21 in an underside thereof communicating with a blower 22. The shell inlet openings 18 in this case communicate with the burner 22 through a hot air chamber 24 within the housing 12 and a burner box 25 extending outwardly of the housing. The shell outlet opening 21 communicates with the blower 22 through an air outlet duct 28, a separable transition duct 29 of a known type, and an air feed cone 30.

Operation of the blower 22 draws ambient air through the burner 20 for heating the air, and the heated air is drawn through the tumbler basket 15 for drying items within the basket as it is rotated. The air is drawn from the tumbler basket 15 through the outlet duct 28, the transition duct 29, and feed cone 30, and is directed by the blower 22 through an exhaust duct 31 which has a selectively positionable damper 32 (FIG. 3) for enabling a portion of the exhaust air to enter a recirculation duct 34 for return to the hot air chamber 24 for recapturing a portion of the heat. The burner 20 and blower 22, in this case, are mounted in a stationary tower 35, with the tumbler 11 and housing 12 being adapted for pivotal movement with respect to the tower 35, as is known in the art, so as to facilitate unloading of the basket 15 upon completion of a drying cycle.

The blower 22 includes a blower wheel 40 rotatably driven by a motor 41. The blower wheel 40 in this case includes an impeller 42 having backwardly inclined blades 44 that point in the direction of rotation of leading edges of the blades 44. The blower 22 has a housing 45 which forms a box-like chamber 46 defined in part by an inner side wall 48 located between the transition duct 29 and the air feed cone 30, a top wall 49 from which the exhaust and recirculation ducts 31, 34 extend, and an outer side wall 50. The blower wheel 40 is disposed within the chamber 46 with the motor 41 supported in outwardly extended fashion relative to the outer side wall 50.

Because of the size and drying requirements of industrial dryers, it is necessary that the blower direct relatively large volumes of air, such as on the order of 6,500 to 11,000 cfm. Heretofore, this has necessitated high operating speeds for the blower, which can create a noisy work environment and necessitate that workers wear ear protection.

In accordance with an important aspect of the invention, the blower is adapted for drawing a high volume air flow through the tumbler at significantly lower blower wheel speeds and noise levels than heretofore possible so as not to adversely affect the work environment nor require that workers wear ear protection. To this end, the blower wheel 40 is larger in diameter and operates at significantly lower speeds than blowers of conventional industrial dryers. More particularly, in achieving the advantages of the invention, the blower wheel 40 has an outer diameter "d" (FIG. 3) of at least about 27 inches and is operated at speeds no greater than about 1,300 RPM for generating air flows sufficient for industrial dryers at noise levels not exceeding about 70 dB. Advantages of the invention are particularly achieved by operating such a blower at speeds no greater than about 1200 RPM for drawing at least 11,000 cfm air flow through the tumbler. Moreover, it has been unexpectedly found that such improved performance can be achieved with more economical, lower horsepower blower motors. In the illustrated embodiment, the blower 22 has a blower wheel 40 which is 32 inches in diameter and is operable at a speed of 1,150 RPM to generate an air flow of 12,000 cfm. The blower 22 is operable for drawing such air flow by means of a motor 41 rated at 15 horsepower and at a noise level of about 70 dB.

By comparison, blowers of conventional industrial dryers have blower wheels from about 18 inches to 24 inches in diameter, which are operated at speeds of between about 1,800 to 3,600 RPM, for drawing air flows between about 6,500 to 11,000 cfm. The noise levels of these conventional blowers typically is in the range of 80 to 95 dB. The lower operating speed of the blower of the present invention greatly improves the operator working environment and eliminates the need for workers to wear ear protection.

Figure 12:
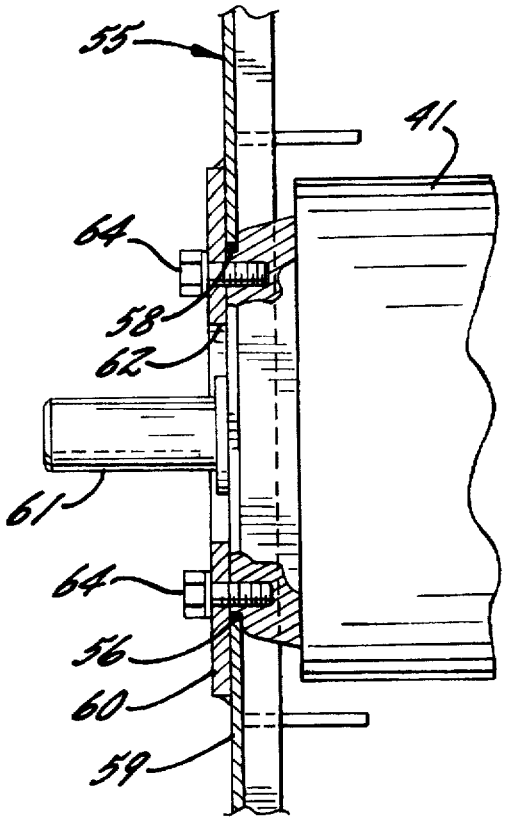
FIG. 12 is an enlarged fragmentary section of the blower motor mount, taken in the plane of line 12—12 in FIG. 11.

In order to permit access to the blower wheel 40 following usage so as to prevent lint build up which can impede operation and create a fire hazard, the blower 22 is supported on a pivotal door 55 of the housing 45. The blower motor 41 in this case is a conventional electric motor known in the art as C-face type, which has a small cylindrical protrusion 56 at a front an end thereof (FIG. 12). To facilitate mounting of the motor 41 in proper position, the protrusion 56 is supported within a cylindrical opening 58 in a main panel 59 of the door 55. In order to secure the motor 41 in mounted position on the door panel 59, a mounting plate 60 is welded to the interior side of the door panel 59. The mounting plate 60 has a central opening 62 through which a drive shaft 61 of the motor 41 extends and a plurality of circumferentially spaced mounting bolt apertures outwardly of the central opening. Mounting bolts 64 extend through the apertures of the plate 60 into threaded engagement with tapped holes in the end of the motor 41, securing the motor in mounted position within the panel opening 58.

Figure 5:
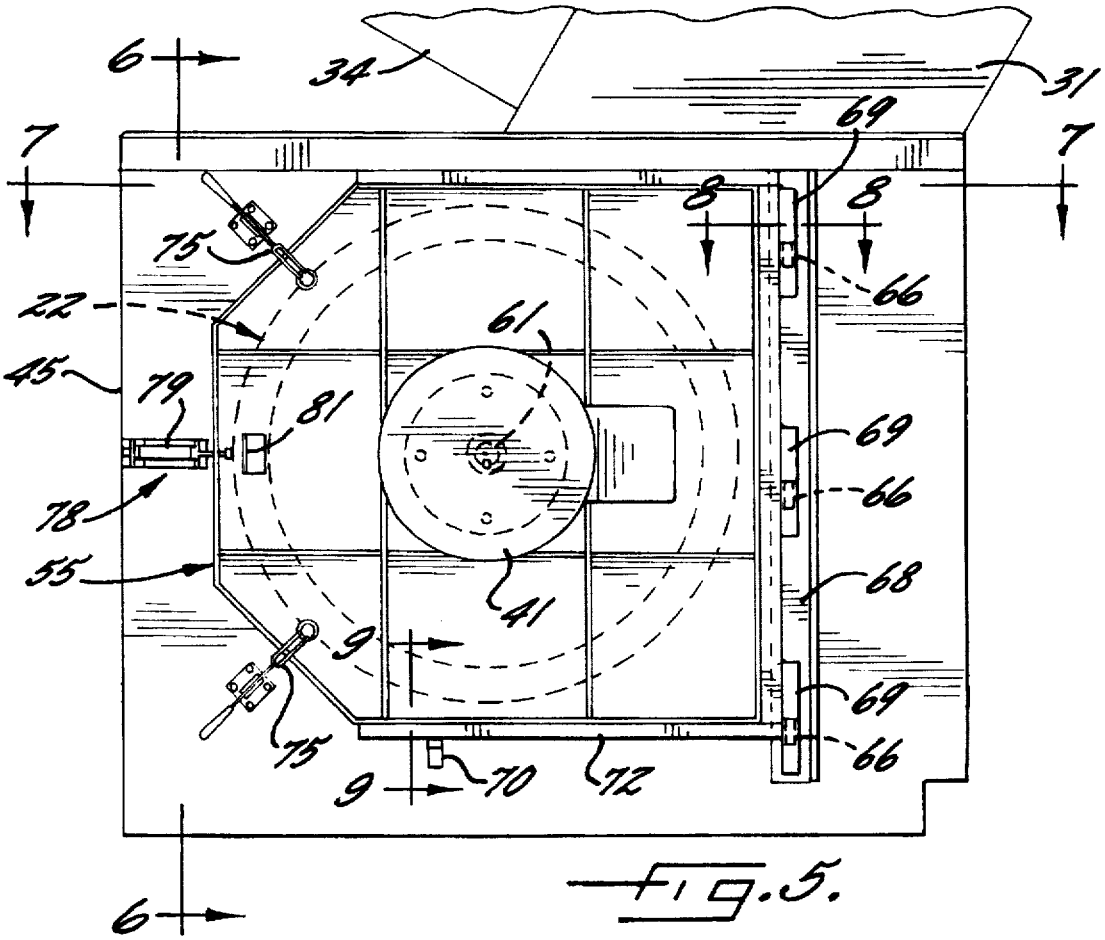
FIG. 5 is an enlarged side elevational view of the door mounted blower of the illustrated dryer.
Figure 6:
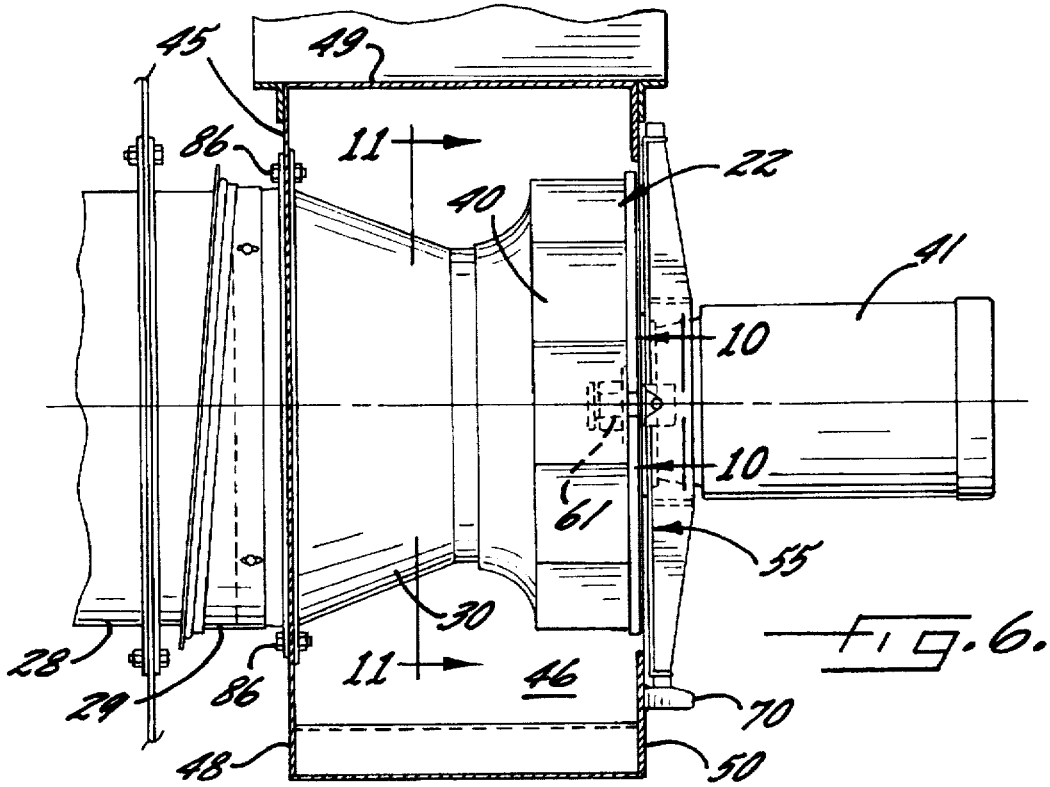
FIG. 6 is a fragmentary section of the blower, taken in the plane of line 6—6 in FIG. 5.
Figure 7:
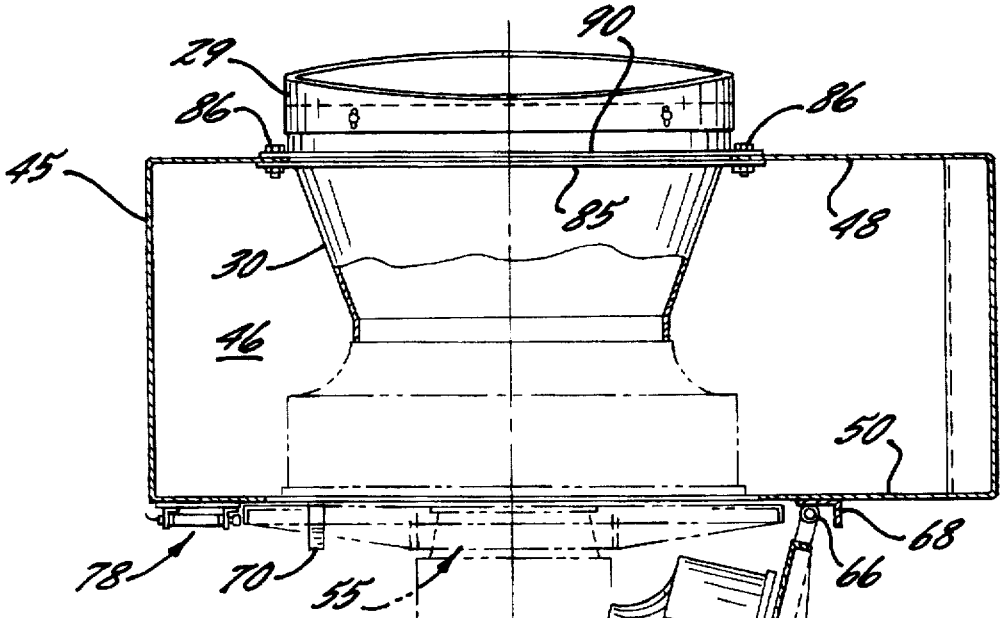
FIG. 7 is a fragmentary section of the blower, taken in the plane of line 7—7 in FIG. 5, showing the blower mounting door in an open position in solid lines and in a closed position in phantom.
Figure 8:
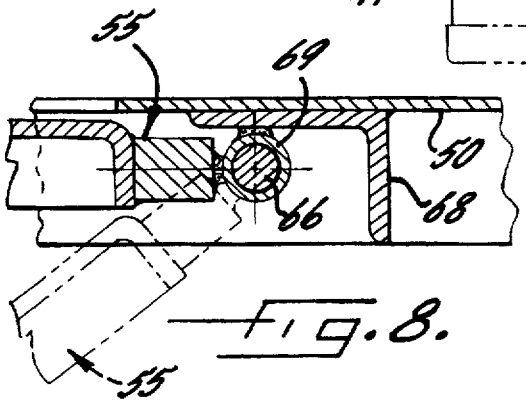
FIG. 8 is an enlarged fragmentary section of the hinge mounting for the pivotal blower door, taken in the plane of line 8—8 in FIG. 5.

For supporting the door 55 for pivotal movement relative to the blower housing 45, a plurality of vertically aligned hinge pins 66 are mounted in outwardly extending relation to the side wall 50 of the blower housing (FIGS. 5, 7 and 8). The hinge pins 66 in this case each are secured at their base, such as by welding, to a reinforcing flange 68 welded to the housing side wall 50 (FIG. 8). The door 55 is provided with corresponding vertically disposed sleeves 69 welded along a hinge mounting side thereof which facilitate relatively easy mounting of the door. The door 55 need only be lifted such that the sleeves 69 are positioned over the hinge pins 66 and then lowered into mounted position onto the hinge pins 66, which thereupon support the door 55 for pivotal movement.

Figure 9:
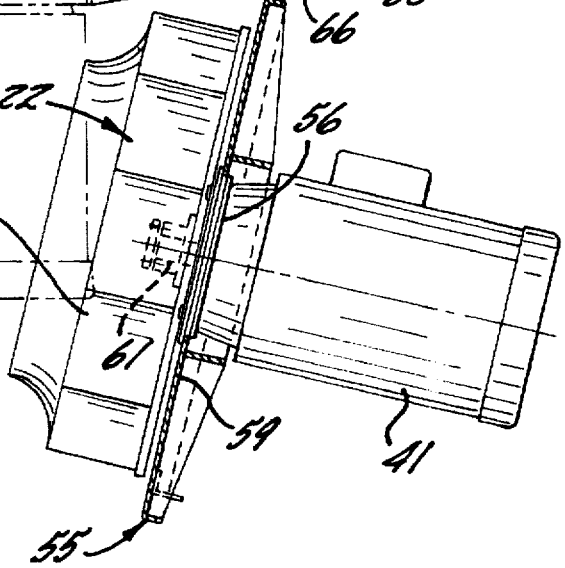
FIG. 9 is an enlarged fragmentary section of the pivotal blower door guide, taken in the plane of line 9—9 in FIG. 5.
Figure 9:
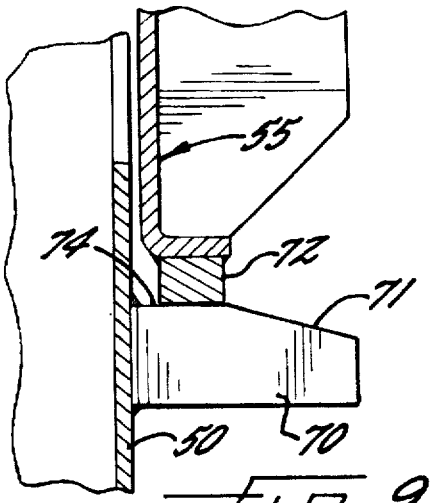

To properly locate the door 55 in its closed position notwithstanding the downwardly directed loading forces on the door caused by the weight of the blower mounted thereon, guides 70 are mounted in outwardly extended relation to the side wall 50, as depicted in FIG. 9. The guides 70 have an upwardly tapered wall 71 extending from a terminal end thereof which guide a bottom rail 72 of the door 55 upwardly onto a horizontal locating platform 74 of the guide, which locates the door in a predetermined closed position. A plurality of over center clamps 75 are provided for securing the door 55 its closed position (FIG. 5).

Figure 10:
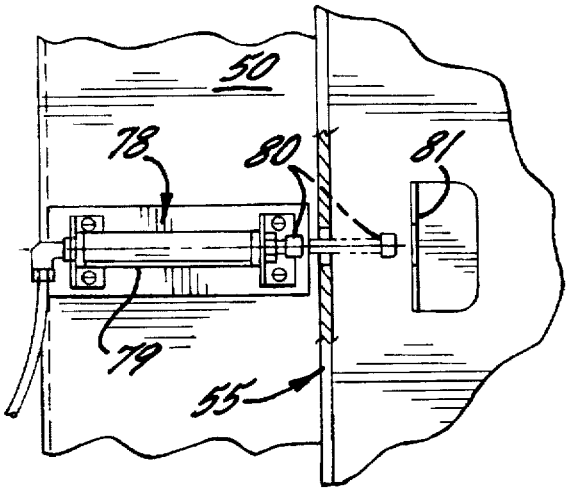
FIG. 10 is an enlarged fragmentary section of the pivotal blower door interlock, taken in the plane of line 10—10 in FIG. 6.
Figure 11:
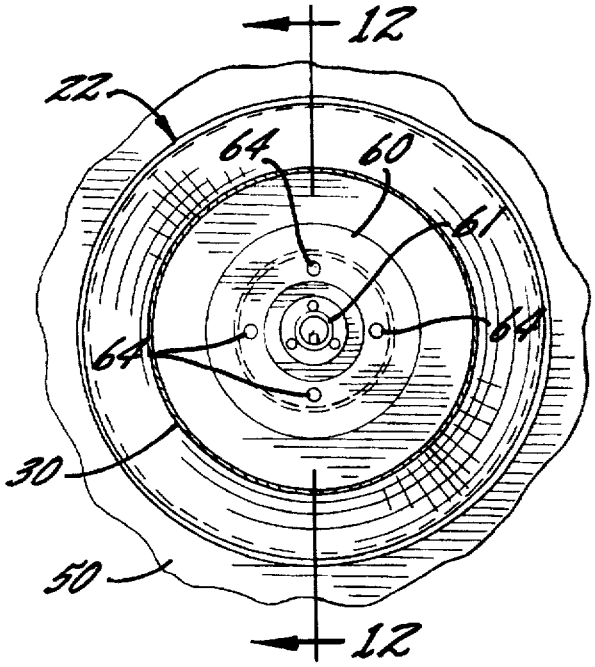
FIG. 11 is an enlarged fragmentary section of the illustrated blower taken in the plane of line 11—11 in FIG. 6.

To ensure that the dryer is operated only when the door 55 is in a closed position, an interlock 78 is provided (FIGS. 5 and 10). The interlock 78 includes an air cylinder 79 which is actuated by the control for the dryer when power to the dryer is turned on. Actuation of the cylinder 79 extends a rod 80 thereof outwardly for closing a contact 81 mounted on the door, which is required by the control in order to enable the dryer to operate. To retract the cylinder rod 80 to permit opening of the door, power to the dryer first must be turned off.

Figure 13:
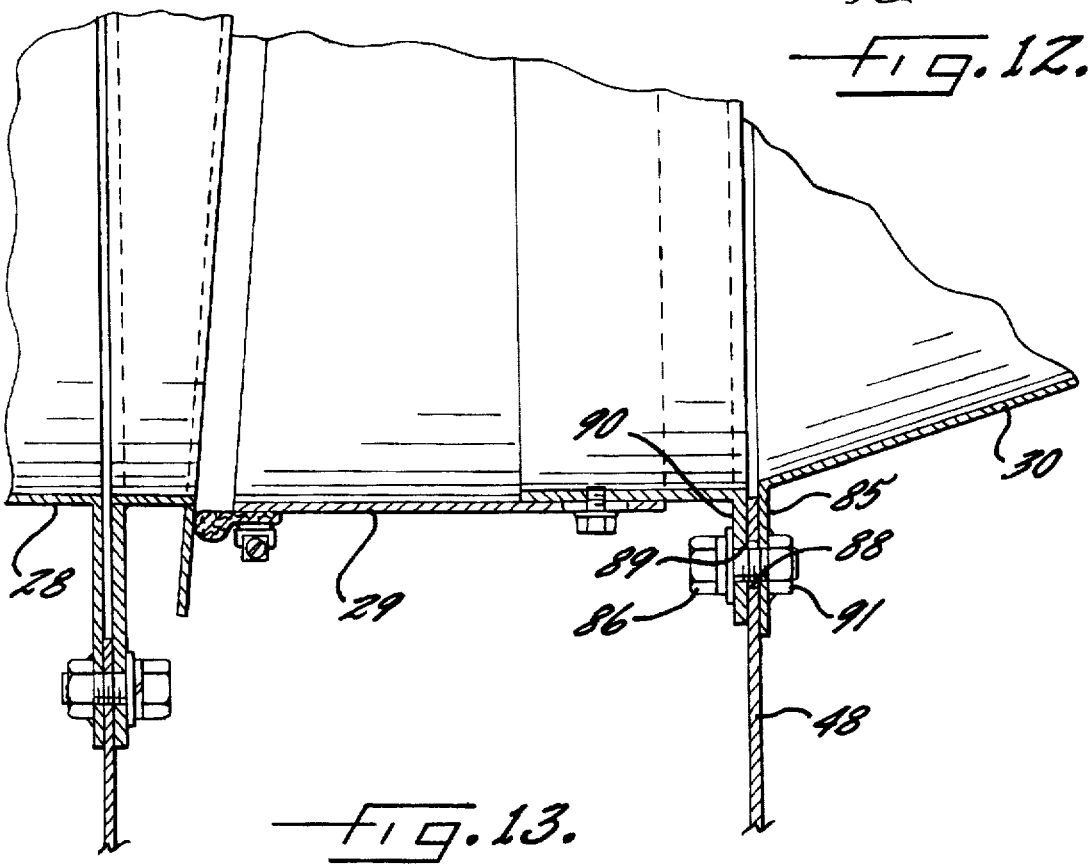
FIG. 13 is an enlarged fragmentary section of the air feed cone and transition duct for the blower of the illustrated dryer.

For directing air axially into the blower wheel 40, the cone 30 has a frusto conical air directing portion tapered inwardly in the downstream direction for channeling air axially into the blower wheel. To secure the cone 30 on the inner side wall 48 of the blower housing 45, the cone has an outwardly extending radial flange 85 at its upstream end formed with a plurality of mounting apertures each for receiving a respective mounting bolt 86 (FIG. 13).

For optimum air flow efficiency through the blower 22, as is known in the art, it is important that the blower wheel 40 be mounted in concentric relation to the inlet cone 30. Since electric motors for such large industrial dryer blowers are relatively large and heavy, weighing up to 300 pounds, effecting and maintaining proper alignment of the blower wheel and air inlet cone has presented problems.

In keeping with the invention, the air inlet cone 30 has an adjustable sealed mounting which facilitates easy and accurate co-axial positioning of the cone with respect to the blower wheel 40. To this end, the side wall 48 of the blower housing 45 is formed with a plurality of mounting apertures 88 substantially larger in diameter than the cone mounting bolts 86 for permitting selective positioning of the cone 30 in the vertical plane. The mounting bolts 86 pass through apertures 89 in an outwardly extending flange 90 of the transition duct 29 which are only slightly larger than the diameter of the mounting bolt, through the enlarged apertures 88 in the side wall 48, and into threaded engagement with fasteners 91 welded to the outer side of the cone mounting flange 85. Upon tightening of the mounting bolts 86, the cone flange 85 and duct flange 90 are drawn into clamping engagement with the side wall 48 for securing the duct 29 and cone 30 in a desired position on the side wall 48 and for effectively closing off and sealing the enlarged apertures 89 in the side wall 48.

Because the mounting apertures 89 in the side panel 40 are substantially larger in size than the mounting bolts 86, prior to final securement of the mounting bolts 86, the cone 30 may be selectively positioned in either the X and Y directions in the vertical plane, or any diagonal direction, so as to achieve accurate co-axial alignment of the cone 30 with the blower wheel 40. Since the cone 30 is substantially lighter in weight than the blower, such selective positioning can be much more easily accomplished than attempting to adjust the blower on the door or the door relative to the housing. Moreover, readjustment of the cone 30 can be easily effected if necessary by simply loosening the mounting bolts 86. Likewise, in the event of damage or wear to the cone 30, as typically occurs from exposure to abrasives after prolonged usage of the blower, the cone can be readily removed and replaced.

Figure 3:
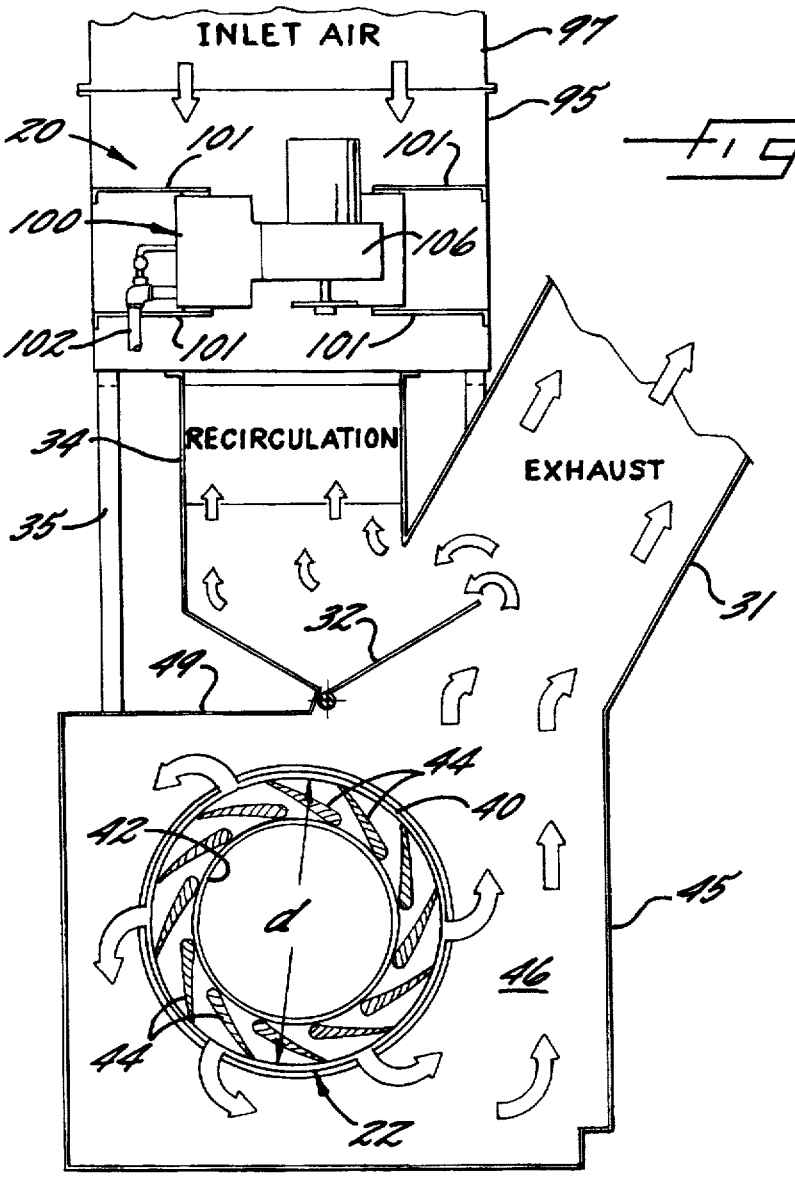
FIG. 3 is an enlarged fragmentary section of the stationary tower of the illustrated dryer, taken in the plane of line 3—3 in FIG. 2.
Figure 4:
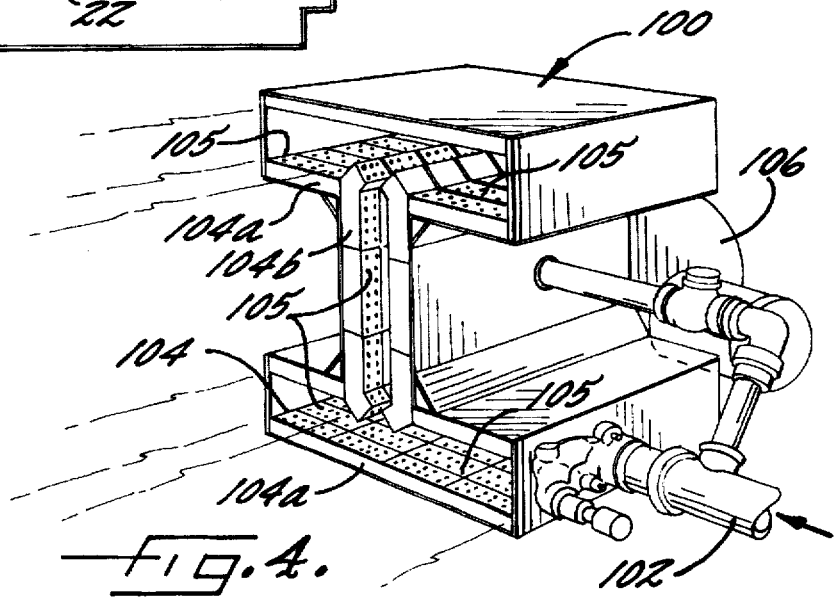
FIG. 4 is an enlarged perspective of the air heating gas burner of the illustrated dryer.

In keeping with a further aspect of the invention, the dryer burner 20 is operable for directing a short length flame having relatively large surface area for more efficient fuel combustion and inlet air heating, while minimizing fire hazard riskS. The illustrated burner 20 includes a box-like housing 95 communicating with an air inlet duct 97 through an upper end thereof and with the burner box 25 through a side thereof. A gas burner unit 100 is disposed within the housing 95, in this case being supported by a flanges 101 extending from side walls of the housing 95 (FIGS. 3 and 4). The burner unit 100 has a fuel inlet line 102 connected to a fuel supply source, preferably natural gas, and includes a burner grate 104 formed with a plurality of discharge passage 105 from which the burner flame is emitted during operation of the burner unit.

For enhanced fuel combustion efficiency, a motor operated blower 106 is mounted adjacent an upstream end of the burner unit 100 for directing combustion air through the burner unit. The burner air inlet duct 97 preferably is connected to ambient air outside of the building in which the dryer is operated so as to eliminate the necessity for drawing in and consuming plant air during operation of the burner.

In carrying out the invention, the grate passages 105 are arranged in a multi-leg configuration adapted for more efficient fuel combustion with a resultant shorter length flame having greater surface area for heating incoming air. The illustrated burner unit 100 has a generally H-shaped grate 104 having top and bottom legs **104*a* interconnected by an intermediate leg 104*b*. Each of the legs 104*a*, 104*b*** is formed with a plurality of discharge apertures for generating a discharge flame having a general H-shaped configuration. A blower unit of this type is commercially available under the Model designation TAH from Eclipse Combustion Co.

In operation of the burner 20, the H-shaped discharge flame from the burner unit 100 extends outwardly a distance of about two feet. By virtue of the multi-leg configuration of the flame, it will be understood that the flame has substantially greater surface area than solid round flames typical of rotary burners used in conventional industrial dryers. For purposes herein, multi-leg discharge flame means a flame having a configuration with multiple legs or facets, in contrast to a discharge flame of a substantially solid round or rectangular cross-sectional pattern. It will be understood that the multi-leg discharge flame may take other configurations, such as X, V, W, and star shapes. In addition to enhanced heating efficiency achieved by such burner unit 100, it will be appreciated by one skilled in the art that the short length discharge flame, in contrast to discharge flames up to six feet in length generated by rotary burners of conventional industrial dryers, substantially minimizes the risk of fire, and particularly the risk of igniting lint that may accumulate within the dryer tumbler.

From the foregoing, it can be seen that the dryer of the present invention is susceptible to more efficient, quieter, and safer operation than conventional industrial dryers. The dryer blower is adapted for generating a high volume air flow at substantially reduced noise levels so as not to disrupt the work environment nor necessitate that workers wear ear protection. The pivotal door mounted blower permits easy access for blower repair and lint removal and is adapted for relatively easy assembly in concentric aligned relation with the air feed cone for efficient air distribution. The multi-leg, relatively short length flame emitted by the burner, furthermore, minimizes the risk of fire.

What is claimed is:

1. A dryer comprising a tumbler having a rotatable basket for containing items to be dried; said tumbler having an air inlet and an air outlet; a burner having a duct communicating with said air inlet; a blower operable for drawing air through said burner for elevating the air temperature, for drawing heated air through said inlet and said tumbler for drying items contained in said tumbler, for drawing air through said air outlet, and for directing the air through an exhaust duct; said blower including a blower wheel and a motor for rotatably driving said blower wheel, and said blower wheel having a diameter of at least 27 inches and being operable at speeds no greater than about 1,300 RPM for drawing an air flow through said tumbler of at least 11,000 cfm at a noise level no greater than about 72 dB.

2. The dryer of claim 1 in which said motor is operable for rotating said blower wheel at a speed of no greater than about 1,200 RPM for drawing air flow through said tumbler of at least 11,000 cfm.

3. The dryer of claim 1 in which said motor is operable for rotating said blower wheel at a speed sufficient to draw at least 11,000 cfm of air through said tumbler at a noise level no greater than 70 dB.

4. The dryer of claim 1 in which said blower wheel includes impellers which have terminal ends oriented in the direction of impeller wheel rotation.

5. The dryer of claim 1 in which said blower wheel has a diameter of about 32 inches.

6. The dryer of claim 1 including an inwardly tapered air feed cone for directing air from said air outlet axially to said blower wheel, a housing having a door upon which said blower wheel and motor are mounted, said door being mounted for pivotal movement between a closed position in which said blower wheel is axially adjacent an inwardly tapered end of said air feed cone and an open position for permitting access to said blower wheel, and said air feed cone being adjustably mounted on said housing for selected positioning with respect to a rotary axis of said blower wheel.

7. A dryer comprising a tumbler having a rotatable basket for containing items to be dried; said tumbler having an air inlet and an air outlet; a burner having a duct communicating with said air inlet; a blower operable for drawing air through said burner for elevating the air temperature, for drawing heated air through said inlet and said tumbler for drying items contained in said tumbler, for drawing air through said air outlet, and for directing the air through an exhaust duct; said blower including a blower wheel and a motor for rotatably driving said blower wheel; an inwardly tapered air feed cone for directing air from said air outlet axially to said blower wheel; a housing having a door upon which said blower wheel and motor are mounted; said pivotal door being mounted for pivotal movement between a closed position in which said blower wheel is axially adjacent an inwardly tapered end of said air feed cone and an open position for permitting access to said blower wheel; and said air feed cone being releasable and adjustably secured on said housing for selected positioning with respect to a rotary axis of said blower wheel.

8. The dryer of claim 7 in which said housing includes a side wall, said feed cone having an upstream end secured to said side wall by selectively engageable and releasable fasteners, and said feed cone being adjustably positionable in the plane of said side wall upon disengagement and release of said fasteners.

9. The dryer of claim 8 in which said fasteners are mounting bolts, said side wall having mounting bolt receiving apertures larger in diameter than said mounting bolts for permitting selected movement of said air feed cone relative to said mounting bolts upon loosening of said mounting bolts.

10. The dryer of claim 9 in which said air feed cone has a mounting flange at an upstream end thereof, and said mounting flange being formed with mounting bolt receiving apertures smaller in diameter than the mounting bolt receiving apertures of said side wall.

11. The dryer of claim 10 including a duct communicating between said air outlet and said air feed cone, said duct having a downstream mounting flange formed with mounting bolt receiving apertures; and said mounting bolts being positionable through said duct mounting flange apertures, said side wall apertures, and said air feed cone flange apertures for adjustably securing said air feed cone in mounted position on said side wall.

12. The dryer of claim 11 in which said side wall apertures are larger in diameter than said mounting apertures of said air feed cone flange and said duct flange.

13. The dryer of claim 11 in which nuts are affixed to one of said flanges in coaxial alignment with the mounting bolt receiving apertures therein, and said nuts each being adapted for threadedly receiving and engaging a respective one of the mounting bolts.

14. The dryer of claim 7 in which said housing includes a side wall, said side wall having a plurality of vertically aligned hinge pins each mounted in outwardly extended relation to said side wall, and said door having a plurality of sleeves mounting along a side thereof, and said door being removably mountable on said hinge pins by positioning said sleeves over said hinge pins.

15. The dryer of claim 7 in which said door includes a door panel formed with a circular opening, and said motor has a cylindrical protrusion at a front end thereof positioned within said circular door panel opening.

16. The dryer of claim 15 including a mounting plate fixed to door panel, said mounting plate having a central opening, said motor having a drive shaft extending through said mounting plate central opening, and said mounting plate being formed with a plurality of motor mounting apertures outwardly of said central aperture, and said motor being secured to said door by mounting bolts extending through said motor mounting apertures and into engagement with an end of said cylindrical motor portion.

17. The dryer of claim 7 in which said housing includes a side wall, said door being hinge mounted to said side wall, and said side wall having guides mounted in outwardly extending relation thereto for locating said door vertically when in a closed position.

18. The dryer of claim 17 in which said guides include an upwardly tapered wall extending from a terminal end thereof for guiding said door into predetermined vertical position as it is being moved to a closed position.

19. The dryer of claim 18 in which said guides includes a horizontal locating surface upon which said door rests when in a closed position.

20. The dryer of claim 7 including means for selectively connecting said dryer to a power source, an interlock for permitting operation of said dryer only when said door is in a closed position, said interlock including an air cylinder having a rod which is extendable to a contact closing position when power is connected to the dryer.

21. The dryer of claim 7 in which said burner has a grate, a combustible fuel feed line communicating with said grate, said grate being configured to direct a multi-leg discharge flame for enhancing fuel combustion and maximizing surface area over which air passes as it is drawn through said burner.

22. The dryer of claim 1 in which said blower has a diameter of about 32 inches, and said motor is operable for rotating said blower wheel at speeds no greater than about 1,200 RPM for drawing at least 11,000 cfm of air through said tumbler.

* * * * *